United States Patent [19]

Gray

[11] 4,098,484

[45] Jul. 4, 1978

[54] CLOTHES RING

[76] Inventor: Carlon Thomas Gray, 422 Cottonwood, Ardmore, Okla. 73401

[21] Appl. No.: 707,528

[22] Filed: Jul. 22, 1976

[51] Int. Cl.[2] ..... A47Q 29/00

[52] U.S. Cl. ..... 248/317

[58] Field of Search ..... 248/302, 303, 317, 318, 248/339, 340, 341, 342, 343, 61, 62

[56] References Cited

U.S. PATENT DOCUMENTS

| | | | |
|---|---|---|---|
| 1,030,969 | 7/1912 | Brenizer | 248/61 |
| 1,265,471 | 5/1918 | Martin | 248/303 X |
| 2,629,575 | 2/1953 | Loyot et al. | 248/317 |
| 3,201,077 | 8/1965 | Heimann | 248/317 X |
| 3,592,431 | 7/1971 | Daidone | 248/317 X |
| 3,601,862 | 8/1971 | Hargadon | 248/317 X |

*Primary Examiner*—William H. Schultz

*Attorney, Agent, or Firm*—Richards, Harris & Medlock

[57] ABSTRACT

A device for coupling a clothing hanger to a clothing hook is disclosed wherein a trapezoidal portion is formed from a strand of rigid material of the size to fit over and hang from the clothing hook with the larger parallel side engaged by the hook and the smaller parallel side positioned below. A helical portion extends from the trapezoidal portion in a plane substantially 90° from a plane of the trapezoidal portion. The helical portion is from the strand of rigid material and the portion is of a size to engage and support clothing hangers therefrom.

2 Claims, 3 Drawing Figures

CLOTHES RING

BACKGROUND OF THE INVENTION

This invention relates to a coupling device and, more particularly, to a device for coupling clothing hangers to a clothing hook.

Clothing hooks are often provided in suitable environments for supporting in an elevated position a clothing hanger carrying an article of clothing. For example, clothing hooks often are attached to the interior roof of an automobile near the window frame. It is often desired to hand on a single clothing hook numerous clothing hangers. An inherent limitation on the number of clothing hangers on a single clothing hook frequently is reached and an attempt to hook more clothing hangers over the clothing hook will result in one or more of the clothing hangers falling off the clothing hook and the clothing will become soiled or wrinkled. The present invention provides a suitable solution to this problem and associated problems.

Herein is disclosed a coupling device of the appropriate size for engaging a clothing hook to provide means for increasing the number of clothing hangers which may be supported from the clothing hook. By using this device clothing hangers engage a portion of the coupling device and are less likely to fall with the clothing thus becoming soiled or wrinkled. Moreover, the present coupling device may be readily transferred from one clothing hook to another without requiring the handling of the individual clothing hangers directly. Thus, the present coupling device enables one to more easily keep clothing free of soil and wrinkling while also providing an easier means of transferring clothing from one clothing hook to another.

The coupling device of the present invention also finds application with wide necked clothing hangers which cannot be supported from conventional clothing hooks. Specifically, certain clothing hangers have decorative wide necks which will not slip over conventional clothing hooks as are normally found in an interior of an automobile. The coupling device of the present invention has a relatively narrow neck to slip over a variety of different sized clothing hooks and thus decorative wide necked clothing hangers can be hung through the use of the coupling device of the present invention.

Thus, the coupling device of the present invention enables one to readily hang more clothing over a variety of different sized clothing hooks and to more easily transfer clothing from one clothing hook to another.

The present coupling device finds ready application in an automobile wherein clothing hooks are normally provided. By supporting the clothing hooks from the coupling device of the present invention more clothing hangers may be held from a single clothing hook. The present coupling device is also useful in other environments, such as, on clothing hooks on doors, in coat closets, in utility rooms, and lockers, and the like. The present coupling device may be utilized in almost any clothing hanging area where clothing hooks are located.

SUMMARY OF THE INVENTION

A device for coupling at least one clothing hanger to a clothing hook is disclosed wherein a trapezodial portion is formed from a strand of rigid material of the size to fit over and hang from the clothing hook with the larger parallel side engaged by the hook and the smaller parallel side positioned below. A helical portion also is formed from the strand of rigid material of the size to releasably retain the clothing hanger and is positioned in a plane substantially 90° from a plane of the trapezoidal portion.

DETAILED DESCRIPTION OF THE DRAWINGS

While the invention will be described in connection with a preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
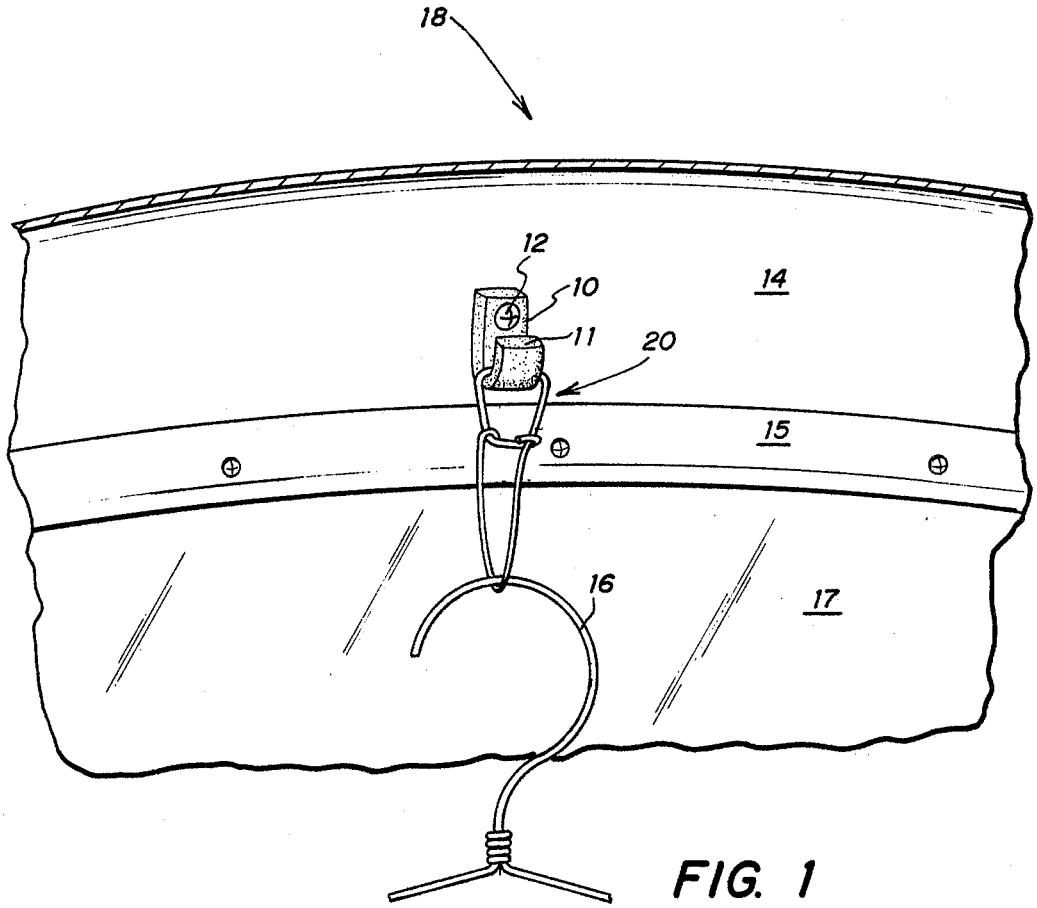
FIG. 1 is a perspective view of the coupling device of the present invention supported from a clothing hook located in an automobile.

Referring now to FIG. 1, the coupling device of the present invention is generally designated as reference numeral 20. Device 20 is depicted in FIG. 1 as supporting a clothing hanger 16 from a clothing hook 10. The hook 10 is affixed to the interior roof 14 near a window frame 15 of an automobile. Device 20 is releasably attachable from clothing hook 12 and fits over a lip 11 of hook 10. Hook 10 is affixed to roof 14 of the automobile by means of screw 12. It is readily apparent from FIG. 1 that device 20 may accommodate numerous clothing hangers 16. Thus, it may be seen that coupling device 20 provides suitable apparatus for supporting clothing hangers 16 from a clothing hook 10.

Figure 2:
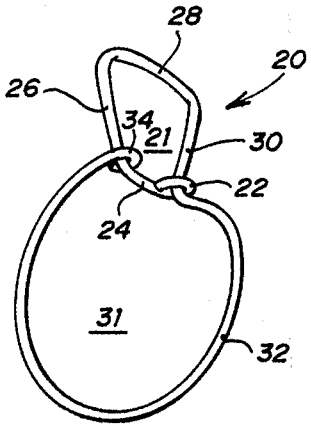
FIG. 2 is a side elevation view of the present invention.
Figure 3:
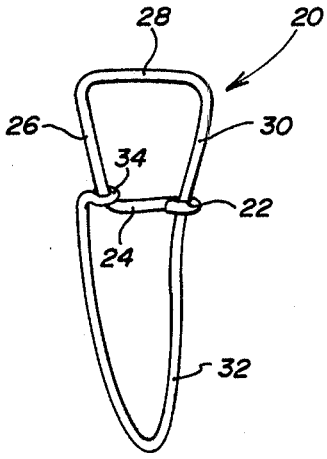
FIG. 3 is a front elevation view of the present invention.

Referring now to FIGS. 2 and 3, the device 20 of the present invention is more fully depicted. Generally, device 20 is constructed from a single strand or length of rigid material which may be any material such as a metal or plastic. Any material can be used which is capable of being shaped in the form of device 20 yet which is able to bear the weight of numerous clothing hangers having pieces of clothing hung therefrom. In the preferred embodiment, the device 20 was constructed from a lightweight metal. Device 20 can be constructed from a material which is colored, thus enhancing the appearance of the coupling device. Device 20 is comprised of two portions, i.e., a trapezoidal portion 21 and a helical portion 31. The trapezoidal portion 21 is preferably in a trapezoidal shape, but may be constructed in a square, rectangular or similar shape. Trapezoidal portion 21 is formed from the strand of rigid material wherein a first end or hook 22 is hooked over an intermediate section of the strand as shown in FIG. 2. The trapezoidal portion 21 of coupling device 20 has a smaller parallel side 24 and a larger parallel side 28. Larger parallel side 28 is adapted to fit over and releasably engage lip 11 of clothing hook 10. Nonparallel first and second legs 26 and 30 form the other opposing sides of device 20.

Coupling device 20 further includes a helical portion 31 formed from the same strand of rigid material as trapezoidal portion 21. This portion 31 functions to releasably engage the clothing hangers 16. Helical portion 31 is positioned to extend transverse to the plane of the trapezoidal portion 21. In this manner, clothing hangers 16 may be coupled to clothing hook 10 whereby the clothing hangers 16 lie in planes substantially parallel to the plane formed by the window 17.

Helical portion 32 is comprised of loop 32 for which clothing hanger 16 may be fit over. Second end portion 34 is adapted to hook over side 26 of trapezoidal portion 21 near the juncture of side 26 and smaller parallel side 24, thereby closing the helical portion 31.

It is thus seen that coupling device 20 provides a means for supporting clothing hangers 16 from clothing hook 10. As is apparent from the present description and disclosure, numerous clothing hangers may be hung from helical portion 31 thus enabling one to hang more pieces of clothing from a single clothing hook.

Thus it is apparent that there has been provided, in accordance with the invention, a coupling device that fully satisfies the aims and advantages set forth above. While the invention has been described in conjunction with a specific embodiment thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. In combination with a clothing hook, a device for coupling at least one clothing hanger to said clothing hook, said clothing hanger comprising:

a trapezoidal portion in a plane roughly parallel to the supporting plane of the clothing hook, formed from a single continuous strand of a rigid material of the size of fit over and hang from the clothing hook with the longer parallel side engaged by the clothing hook and the shorter parallel side positioned there below to prevent disengaging upward movement, each of said parallel sides being continuous along their entire length and composed of a single strand of said rigid material; and a helical portion, formed from the same continuous strand of the rigid material, of the size to releasably retain the clothing hanger, the helical portion extending transverse to the plane of the trapezoidal portion.

2. A device for coupling at least one clothing hanger to a clothing hook, comprising:

a continuous strand of rigid material bent to form a first trapezoidal portion and a second helical portion, said strand having a first end forming a first hook;

the strand extending from the hook to define a lower side;

the strand extending from the lower side at an obtuse angle from the lower side to define a first leg;

the strand extending from the first leg at an acute angle to define an upper side;

the strand extending at an acute angle to define a second leg;

the strand extending through the hook;

the strand further defining extending in a plane substantially 90° from the plane in which the trapezoidal portion lies to define a helical portion; and the strand extending to and defining a second hook at a point adjacent the intersection of the lower side and first leg, whereby the upper portion of the trapezoidal portion fits over and hangs from a clothing hook and the helical portion releasably retains the clothing hanger.

* * * * *